US007455458B2

(12) United States Patent
Johal et al.

(10) Patent No.: US 7,455,458 B2
(45) Date of Patent: Nov. 25, 2008

(54) BEARINGS

(75) Inventors: Charan Preet Singh Johal, Birstall (GB); John Carey, Northants (GB)

(73) Assignee: Mahle Engine Systems Ltd., Ayrshire (GB)

( * ) Notice: Subject to any disclaimer, the term of this patent is extended or adjusted under 35 U.S.C. 154(b) by 0 days.

(21) Appl. No.: 11/654,726

(22) Filed: Jan. 18, 2007

(65) Prior Publication Data

US 2007/0160315 A1 Jul. 12, 2007

Related U.S. Application Data

(62) Division of application No. 10/521,072, filed as application No. PCT/GB03/02640 on Jun. 20, 2003, now Pat. No. 7,174,637.

(30) Foreign Application Priority Data

Jul. 13, 2002 (GB) ..... 0216331.9

(51) Int. Cl.
*F16C 33/02* (2006.01)

(52) U.S. Cl. ..... 384/276; 384/294; 384/912

(58) Field of Classification Search ..... 384/276–278, 384/288, 294, 552–554, 912–913; 428/457, 428/614, 646–648, 652
See application file for complete search history.

(56) References Cited

U.S. PATENT DOCUMENTS 3,658,488 A * 4/1972 Brown et al. ..... 428/613
4,717,460 A 1/1988 Nobel et al.
4,871,429 A 10/1989 Nobel et al.
5,021,130 A 6/1991 Metzger et al.
5,156,729 A 10/1992 Mahrus et al.
5,334,460 A * 8/1994 Tanaka et al. ..... 428/552
5,712,049 A 1/1998 Huhn et al.
5,882,587 A * 3/1999 Okamoto et al. ..... 420/570
6,000,853 A * 12/1999 Lytwynec et al. ..... 384/294
6,086,742 A 7/2000 Huhn et al.
6,301,784 B1 10/2001 Niegel et al.
6,309,760 B1 * 10/2001 Lyon et al. ..... 428/646
6,316,061 B1 * 11/2001 Andler et al. ..... 427/566
6,706,126 B2 * 2/2002 Lyon et al. ..... 428/646
6,357,918 B1 * 3/2002 Kagohara et al. ..... 384/276

(Continued)

FOREIGN PATENT DOCUMENTS

DE 37 27 591 A1 3/1989

(Continued)

OTHER PUBLICATIONS

GB Search Report dated Jan. 6, 2003 (1 page).

(Continued)

*Primary Examiner*—Marcus Charles
(74) *Attorney, Agent, or Firm*—Rader, Fishman & Grauer PLLC

(57) ABSTRACT

A plain bearing and method for making the same are shown and described. The plain bearing includes a layer of a strong backing material to which a first bearing alloy is bonded. A second layer of bearing material overlays the first bearing layer and comprises essentially pure tin without any other metallic alloying constituents and an organic levelling agent in the matrix thereof.

7 Claims, 8 Drawing Sheets

U.S. PATENT DOCUMENTS

| | | | | |
|---|---|---|---|---|
| 6,472,086 | B2 * | 10/2002 | Lyon et al. | 428/647 |
| 6,676,898 | B2 * | 1/2004 | McMeekin et al. | 420/530 |
| 2001/0016267 | A1 * | 8/2001 | Huhn et al. | 428/647 |
| 2003/0048961 | A1 * | 3/2003 | Kawachi et al. | 384/276 |
| 2003/0170470 | A1 * | 9/2003 | Sato et al. | 428/457 |

FOREIGN PATENT DOCUMENTS

| | | | | |
|---|---|---|---|---|
| EP | 0 257 670 | A1 | | 3/1988 |
| EP | 0379948 | | | 1/1990 |
| EP | 0 379 948 | A2 | | 8/1990 |
| EP | 1113180 | | | 7/2000 |
| GB | 702188 | | | 1/1954 |
| GB | 2 186 923 | A | | 8/1987 |
| GB | 2 221 502 | A | | 2/1990 |
| GB | 2 228 011 | A | | 8/1990 |
| JP | 05240252 | A | * | 9/1993 |
| WO | WO-00/29647 | | | 5/2000 |

OTHER PUBLICATIONS

International Search Report (2 pages).
Derwent English Abstract for DE 37 27 591 A1 (1 page).
Delphion English Abstract for EP 0 379 948 A2 (2 pages).
Jordon, Manfred Dr., "Die galvanische Abscheidung von Zinn und Zinnlegierungen", 1993 pp. 64-84 (partial English translation provided.
Billiter, Jean, "Prinzipien der Galvanotechnik", 1984.
Detiner, Heinz W. Dr et al., "Hanbuchder Galvanotechnik", 1966.
Jordon, Manfred, Dr. "Tin Deposition from Acid Electrolytes, 1993, pp. 64-84 (understood to be English translation of "Die galvanische Abscheidung von Zinn und Zinnlegierungen" listed as CA").
Letter from Fuchs, Mehler et al. to the EPO dated May 23, 2007, Opposition to European Patent 1 520 064 B1.

* cited by examiner

BEARINGS

CROSS-REFERENCE TO RELATED APPLICATIONS

This application is a divisional of U.S. application Ser. No. 10/521,072 filed Jan. 13, 2005, now U.S. Pat. No. 7,174,637, filed under 35 U.S.C. § 371 as a national phase entry of International Application No. PCT/GB2003/002640 on Jun. 20, 2003.

FIELD

The present invention relates to plain journal bearings, particularly though not exclusively, for internal combustion engines and to so-called overlay coatings deposited upon the running sliding surface of such bearings.

BACKGROUND

Overlay coatings on plain journal bearings are well known. Such coatings are used to improve the running characteristics of plain bearings. Generally, overlay coatings are relatively soft metal alloys having a hardness in the region of about 15 Hv; are frequently based on alloys of lead; and, are deposited on another harder bearing alloy at a thickness in the range from about 10 to 30 μm. Overlay alloys of the type under consideration are usually applied by electro-deposition from aqueous plating solutions.

The bearings on which the overlays are deposited are of generally cylindrical or, more commonly, semi-cylindrical form as half-bearing shells which support the crankshaft journals of internal combustion engines, for example. Such bearings generally comprise a layer of a strong backing material such as steel, for example, on which is bonded a layer of a bearing material frequently chosen from alloys of aluminium or copper. The method of attaching the layer of bearing alloy to the strong backing may be any that is suitable and may include techniques such as pressure welding of sheets of bearing alloy to the backing; the casting of molten alloy onto the backing; or, the sintering of powders of alloy to the backing, for example, these methods not being exhaustive. The overlay alloy coating is deposited on the surface of the harder bearing alloy and endows the finished bearing so formed with properties which include conformability and the ability to embed dirt particles and so prevent scoring of a shaft journal by particles of debris carried in the lubricating oil. Although overlay alloys in their bulk form are relatively weak alloys, they have the ability when applied as a thin layer to another, harder bearing alloy to increase the fatigue strength of a bearing embodying that harder and intrinsically stronger bearing alloy. This is effected due to the conformability of the overlay alloy by being able to deform slightly to accommodate slight mis-alignments, especially in new engines during the "running in" phase, and so spread the load more evenly across the bearing surface area.

As noted above, many conventional overlay alloys are based on alloys of lead. Lead is a toxic metal which will eventually be phased out of use by governmental legislation throughout the world. In order to make the lead-based overlay layer less prone to corrosion in hot engine oils about 10 weight % of tin is frequently added or, alternatively, 7 to 10 wt % of indium. Indium, however, is relatively very expensive compared with tin and tends to be used for more expensive, higher performance vehicles. However, when tin is used in the overlay alloy and is deposited upon a harder bearing alloy such as copper-lead, for example, a problem exists in that the tin under engine operating conditions tends to diffuse out of the overlay into the lead of the underlying bearing alloy, as does indium. This is solved by coating the surface of the underlying, harder bearing alloy with a thin diffusion barrier of about 1-3 μm of a metal such as nickel. However, this is not entirely satisfactory as diffusion still occurs and the overlay still becomes depleted in tin due to the formation of non-equilibrium intermetallic compounds such as $Ni_3Sn$ or $Ni_3Sn_2$ which are not good bearing materials in the situation where the shaft journal wears through the overlay to the underlying interface comprising these intermetallic compounds.

With the ever increasing demands placed on bearings by engines having higher specific outputs and operating at higher engine revolutions, there has been a demand for these relatively soft overlay alloys to have improved wear resistance whilst at least maintaining existing levels of fatigue, cavitation resistance and corrosion resistance. This demand has resulted in the development of so-called lead-tin-copper overlay alloys an example of which is Pb-10Sn-2Cu.

Thus, it is an object of the present invention to provide an overlay layer which is not toxic and a further object is to provide an overlay which does not form undesirable compounds at an interface with an underlying, harder bearing material. A yet further object is to provide an overlay having improved performance over known lead-based overlay alloys.

SUMMARY

According to a first aspect of the present invention there is provided a plain bearing having an overlay material layer at a sliding surface of the plain bearing, the plain bearing comprising a layer of a strong backing material, a layer of a first bearing alloy bonded to the strong backing material and a layer of a second bearing alloy comprising said overlay material bonded to said first bearing alloy layer wherein said second bearing material comprises tin having included in the matrix thereof an organic levelling agent.

The tin overlay layer according to the present invention comprises essentially pure tin in that there are no metallic alloying constituents, other than unavoidable impurities, however, the tin is deposited from a bath containing additions of one or more organic materials which have the effect of so-called "levelling" on the electro-deposited tin layer.

Organic materials which have been tested in bearings of the present invention embodying tin overlays include nonylphenolpolyglycolether and pyrocatechol. The content of the organic material in the plating bath has an influence on the degree of levelling achieved in the deposited tin layer, the degree of levelling being reflected in the surface roughness of the tin layer.

At low levels of organic levelling agent, too low for the full benefit of the present invention to be felt, the surface appearance of the bearing surface is one of a generally crystalline appearance having pools of smooth material distributed over the surface. At a content of organic levelling agent where the whole surface is smooth, this is the desirable minimum content.

It is believed that the organic levelling agent is incorporated in the matrix of the deposited tin layer as polymer chains occluded in the matrix structure such as in the form of an organo-metallic tin compound, for example. The polymer chains appear to impart a preferred orientation to the tin atoms during deposition which has been found to give improved slip properties. Improved slip properties have been evidenced by lower coefficients of friction in the tin layer compared with ordinary tin deposits without the levelling additions. The surface of the tin overlay of the bearing of the present invention is very smooth giving a lower degree of friction against a co-operating shaft journal which in turn gives improved compatibility between bearing surface and shaft journal resulting in lower wear rates.

The organic constituent of the tin overlay produces an increased hardness in the range from about 20 to 30 Hv. Pure tin with no organic levelling agent, depending upon its condition, has a hardness of about 8-12 Hv. The hardness of the tin overlay can be changed depending upon the content of the organic levelling agent in the plating bath; the lower the content, the lower the corresponding hardness. The reverse is also true in that as the content of levelling agent increases, so also does the hardness. However, it is possible to have too high a content of organic levelling agent such that the hardness is too high and high internal stresses are produced in the deposit which can lead to cracking of the tin deposit. It is intended that the overlay of the bearing of the present invention operates in a similar manner to conventional overlays in that the overlay layer is sufficiently soft to permit particles of dirt circulating in the lubricating oil to become embedded in the overlay so as to prevent such dirt particles from scoring the shaft journal. Whilst the tin overlay of the present invention is harder than pure tin by a factor of ×2 to ×3 it is still sufficiently soft to provide the required characteristic of dirt embeddability thus, the preferred hardness range is 20 to 30 Hv.

The bearing of the present invention may preferably have an interlayer between the surface of the first bearing material and the tin overlay to act as a diffusion barrier therebetween. The metal layer may be of a thickness lying in the range from about 0.1 to about 3 μm with a thickness of 1 to 2 μm being preferred, however, the actual thickness is of comparatively little importance in terms of bearing performance. The metal may be selected from the non-exhaustive group including nickel, cobalt, copper, silver, iron and alloys of these metals, for example. It has been found that under engine operating conditions the tin overlay reacts with the nickel interlayer over time to form the stable equilibrium intermetallic compound, $Ni_3Sn_4$, due to the presence of effectively an excess of tin. As noted above, prior art lead-10tin overlays tended to form the unstable, non-equilibrium $Ni_3Sn$ or $Ni_3Sn_2$ compounds which are poor bearing materials and have inferior compatibility with a shaft journal and have been blamed in the past for causing seizure when the overlay has worn through to the interlayer. $Ni_3Sn_4$ on the other hand is a very good bearing material and thus, the overlay of the present invention in addition to having superior resistance to wear and cavitation erosion is also less prone to seizure when the overlay is nearing the end of its life. Thus, this unforeseen effect of generating a good bearing material at the interface is seen as a significant advantage of the bearing of the present invention.

As with known overlay layers, the thickness of the overlay of the bearing of the present invention may lie in the range from about 10 to 30 μm with 13 to 18 μm being preferred.

The deposition conditions for tin overlays according to the present invention may be varied to produce a range of microstructures. For example, analysis of the tin overlay layer by SEM has revealed no discernible grain size; even at magnifications of ×5000 and ×10000 no grains can be resolved. However, coatings having grain sizes of up to 3 μm may be produced. It is preferred, however, that a smaller grain size is produced as these provide improved bearing properties.

According to a second aspect of the present invention, there is provided a method for the deposition of an overlay layer onto the surface of a plain bearing, the bearing comprising a strong backing material having a layer of a first bearing material thereon, said overlay being deposited upon the surface of said first bearing material, the method comprising the steps of: providing a bearing having a surface on which to deposit said overlay; immersing said bearing in a plating solution having a supply of tin ions and an organic levelling agent in said solution; making said bearing cathodic with respect to an anode in said solution; and depositing an overlay of tin, apart from unavoidable impurities, said tin overlay also having said organic levelling agent included in a matrix thereof.

It is preferred to deposit the tin overlay of the bearing of the present invention by using a so-called "slot jig" wherein the bearing is held with its joint faces against a back face of the slot jig with the bore of the bearing facing the slot, the bearing axis and slot being generally parallel to each other. The plating solution, in which the bearing and slot jig are immersed, is also then sparged through the slot towards the bearing bore.

In this way it has been found that relatively high current densities of 2 to 3 $A/dm^2$ may be employed compared with less than 1 $A/dm^2$ where the bearing is merely immersed in the plating solution without sparging thereof. Furthermore, the quality of the deposited tin layer is greatly improved compared with that produced without sparging. The use of high current density permitted by the slot jig and sparging technique also reduces plating time from more than 40 minutes to less than 20 minutes.

A typical plating solution producing a tin/organic material overlay on a bearing according to the present invention may have a composition as follows:

| | |
|---|---|
| $Sn^{++}$ | 32-38 g/l |
| $SnSO_4$ | 58-68 g/l |
| $H_2SO_4$ | 185-210 g/l |
| Cu | <50 mg/l |
| Chloride | <20 ppm |

Levelling agent additions of nonylphenolpolyglycolether (10-25%) in a methanol carrier (2.5-10%) in the range from 18 to 70 ml/l to the solution specified above have been tested. At the lower end of the range it was found that the degree of levelling and hardness increase was insufficient whilst at the upper end of the range it was found that there was too much inherent stress in the tin deposit and cracking occurred. It was found that concentration in the range from 25 to 55 ml/l gave useful increases in overlay performance with little or acceptable deterioration of the fundamental requirements of an overlay alloy in terms of conformability and dirt embeddability. The content of pyrocatecol was 2.5-10% and amphoteres tensid 2.5% maximum.

It has been found that the leveler content has a substantially directly proportional effect on hardness of the tin deposit. However, a limit of leveler content is reached after which the hardness of the tin deposit remains constant and then actually begins to fall after further increasing the leveler content. Similarly, the leveler content also has a directly proportional effect on surface roughness once the effect of the initial substrate roughness and greatly increased surface roughness of the initial leveler-free tin deposit have been overcome.

BRIEF DESCRIPTION OF THE DRAWINGS

In order that the present invention may be more fully understood, examples will now be described by way of illustration only with reference to the accompanying figures, of which.

DETAILED DESCRIPTION

Figure 1:
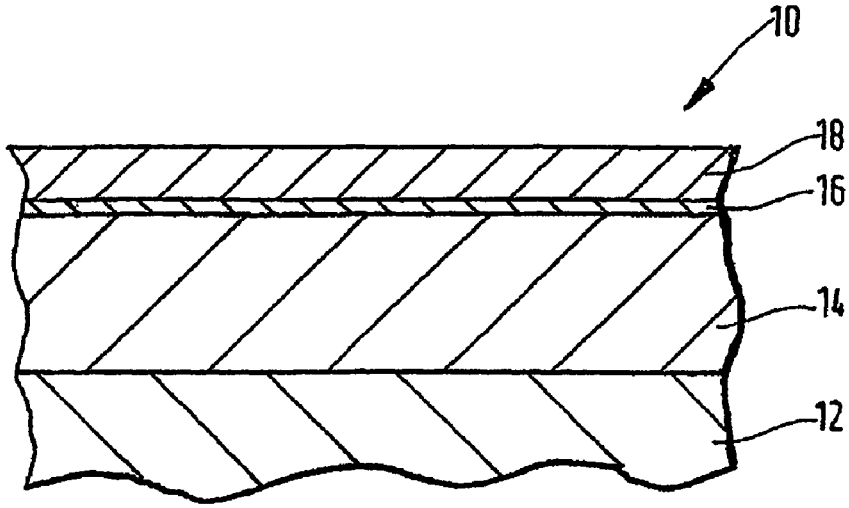
FIG. 1 shows a cross section through a part of a schematic bearing according to the present invention showing the constituent layers.

Referring now to FIG. 1 which shows a cross section of a small portion of a generalised bearing 10 according to the present invention. The bearing comprises: a strong backing material 12 (only a part of the thickness of which is shown); a layer of a first bearing material 14 bonded to the backing 12; an interlayer 16; and, an overlay layer 18 of tin which includes an organic levelling agent combined in the matrix thereof. The backing layer 12 may be steel, for example, but may be any other suitable material such as bronze for example if corrosion conditions in the application dictated such. The first bearing material layer 14 may be any that is suitable but will generally be chosen from copper-based alloys or aluminium-based alloys. The interlayer 16 is present to form a diffusion barrier to stop rapid diffusion of the tin from the overlay 18 into the bearing alloy layer 14 in the case of copper-based alloys 14 and to improve the adhesion of the overlay to the bearing alloy in the case of aluminium-based alloys 14. The interlayer will generally be deposited by electro-deposition where the overlay is so deposited and may comprise a layer of nickel or other suitable material as described hereinabove. In use, the bearing 10 will be subject to temperatures up to about 160° C. At temperatures of 90° C. and above, the tin from the overlay will react with the interlayer material to form the stable intermetallic compound $Ni_3Sn_4$ in the case of a nickel interlayer. The rate of formation increases as the temperature rises. The $Ni_3Sn_4$ layer grows at the expense of the overlay, however, the $Ni_3Sn_4$ layer is a good bearing material per se with good compatibility with the co-operating shaft journal (not shown) and thus, does not present a possible seizure threat. The thickness of the interlayer 16 generally lies in the range from 1 to 3 μm and the thickness of the overlay 18 generally in the range from 13 to 18 μm.

Figure 2:
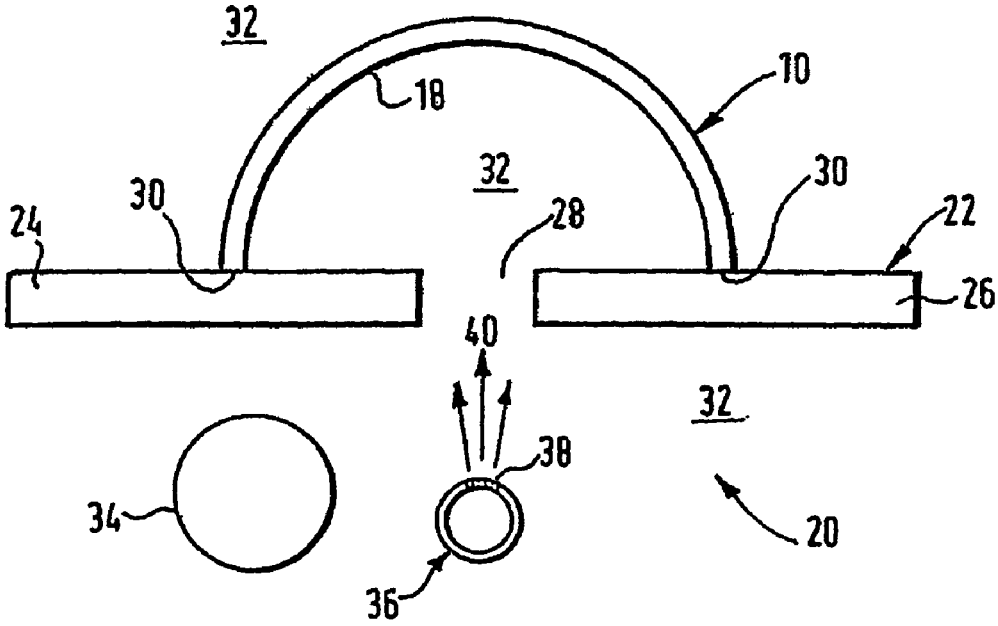
FIG. 2 shows a top view of a schematic arrangement of a plating jig having a bearing being plated with a tin/organic material according to the method of the present invention.

FIG. 2 shows a top plan view of a schematic arrangement 20 of electro-plating apparatus for depositing an overlay 18 on a bearing 10. The apparatus comprises a jig 22 having two plates 24, 26 spaced either side of a slot 28. The bearing 10 is held against the plates 24, 26 on its joint faces 30. The jig 22 is immersed in a bath (not shown) of plating solution 32 as is a tin anode 34 of generally cylindrical form. The bearing 10 is made cathodic by a suitable electrical connection (not shown). A sparging tube 36 having holes 38 is situated vertically in the bath in a fixed relationship to the slot 28. Plating solution is pumped through the tube 36 so as to emerge in jet form, as indicated by the arrows 40, which are directed towards the bore of the bearing 10 through the slot 28. Although not apparent from FIG. 2, the jig 22 is elongate as are the anode 34 and sparging tube 36 and there is generally a stack of a plurality of bearings 10 being plated simultaneously.

In the tests results which follow, the overlay was deposited upon the relevant substrate alloy bearing alloy 14 and interlayer 16 from a plating bath having the following composition:

| | |
|---|---|
| $Sn^{++}$ | 32-38 g/l |
| $SnSO_4$ | 58-68 g/l |
| $H_2SO_4$ | 185-210 g/l |
| Cu | <50 mg/l |
| Chloride | <20 ppm |

Levelling agent additions of nonylphenolpolyglycolether (10-25%) in a methanol carrier (2.5-10%) in the range from 32 to 35 ml/l were added to the above aqueous solution.

The interlayer 16 material was in all cases nickel.

Figure 3:
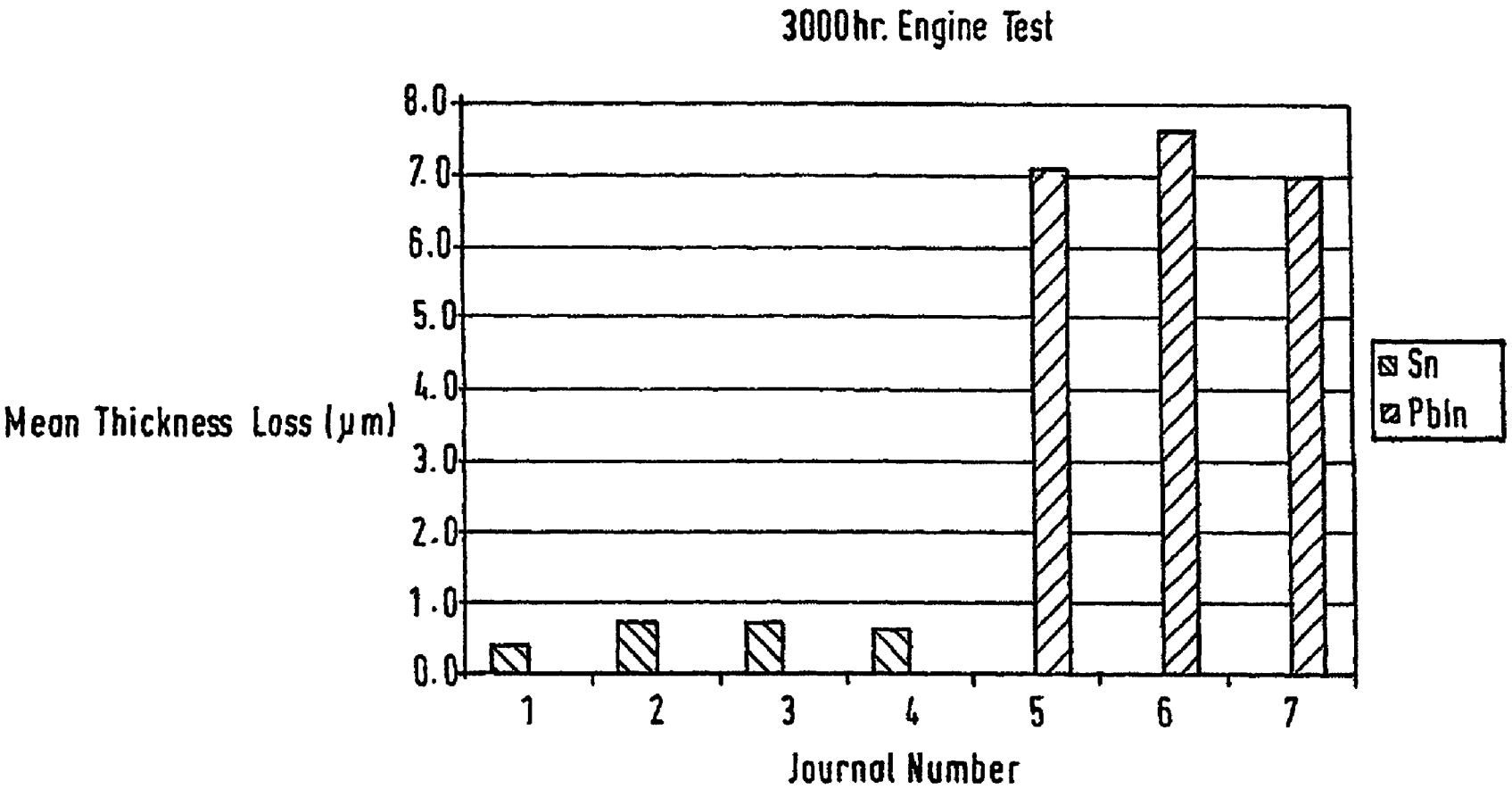
FIG. 3 shows a histogram of mean thickness loss of overlay vs main journal number in an engine test comparing bearings according to the present invention and bearings plated with known Pb/In overlays.

FIG. 3 indicates the results of a 3000 hour test on a Volvo (trade name) diesel truck engine. Main bearings 1 to 4 inclusive were fitted with bearings according to the present invention as described above whilst main bearings 5 to 7 inclusive were fitted with bearings of the same material and construction but having a conventional overlay of Pb-7In. As may be seen from the histogram of FIG. 3, the mean overlay thickness loss for bearings of the present invention was less than 10% that of the conventional overlay.

Figure 4:
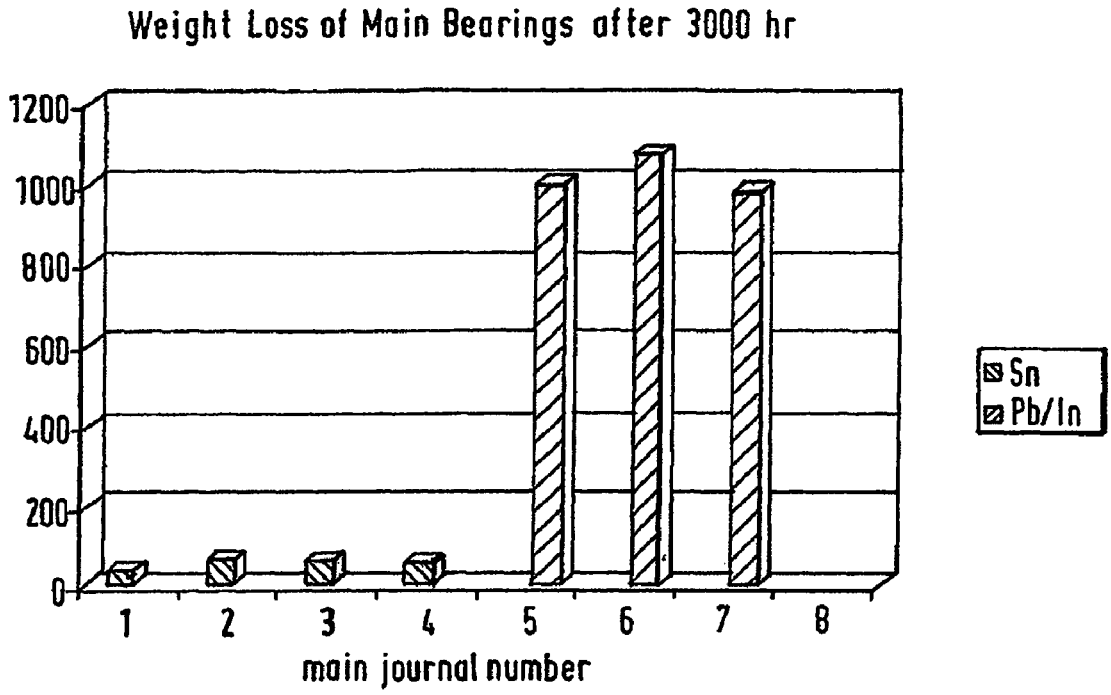
FIG. 4 shows a histogram of weight loss vs main journal number of overlays of bearings according to the present invention and known Pb/In plated bearings in a 3000 hour engine test.

FIG. 4 shows the results of the 3000 hour Volvo engine test of FIG. 3 in terms of weight loss. Weight loss of the bearings according to the present invention was significantly less than 100 mg each for the four main bearings on journals 1 to 4 whereas the weight loss of the bearings on journals 5 to 7 was around 1000 mg each.

Figure 5:
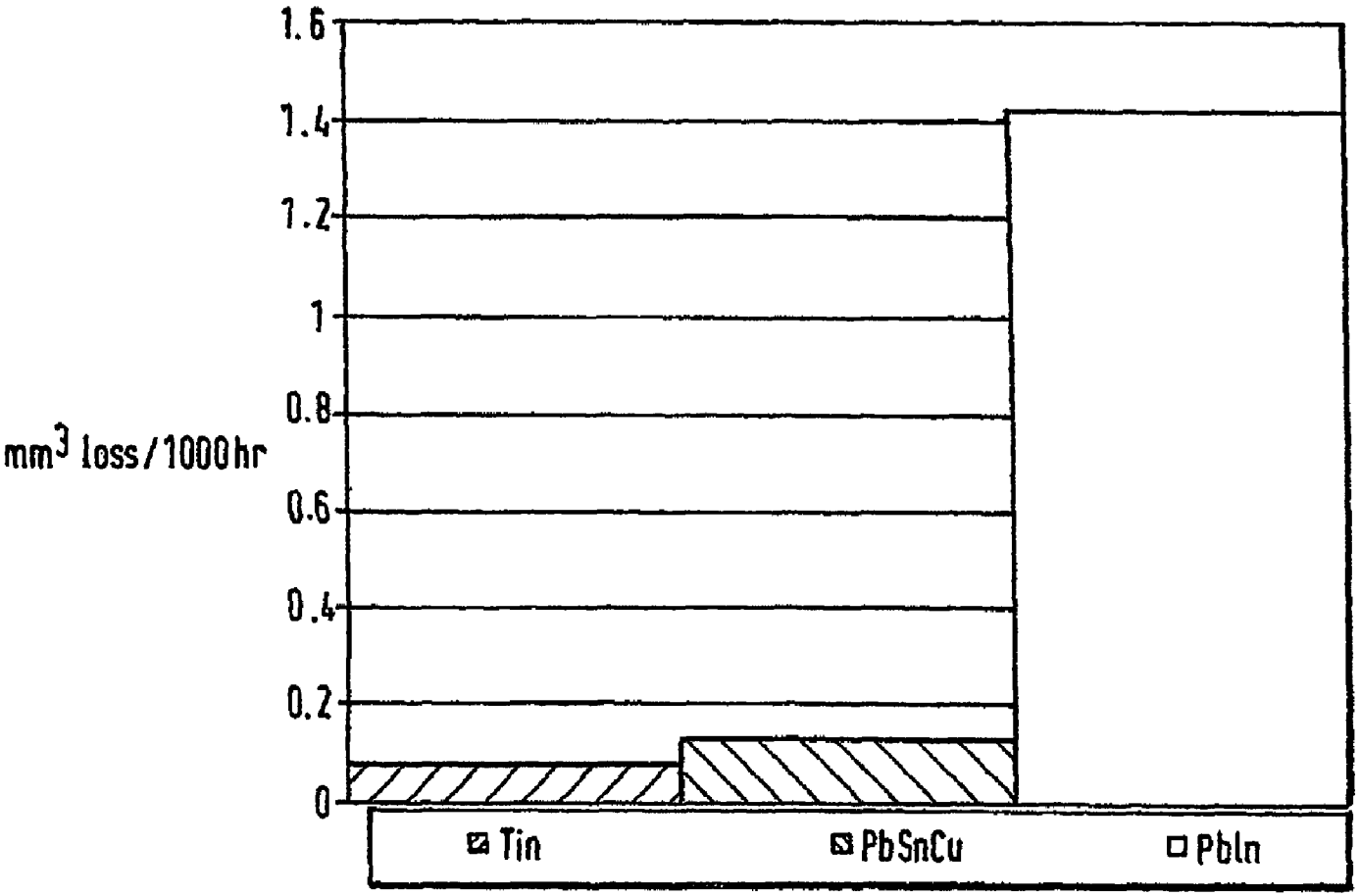
FIG. 5 shows a histogram of volume loss of overlays of bearings according to the present invention and known Pb/In and Pb/Sn/Cu overlays in a hot oil corrosion test.

FIG. 5 is a histogram showing weight loss of overlays in hot oil (white medicinal oil which is chosen for its particularly corrosive nature) after 1000 hours at 120° C., the loss being measured in $mm^3$. The bearing material on which the overlays were deposited has a composition CuSn10 which was cast onto steel. The overlays were tin as in the present invention, Pb-7In and Pb-10Sn-2Cu. As may be seen from FIG. 5, the volume loss of overlays on bearings according to the present invention was about 60% that of Pb-10Sn-2Cu and much less than 10% that of the Pb-7In overlay.

Figure 6:
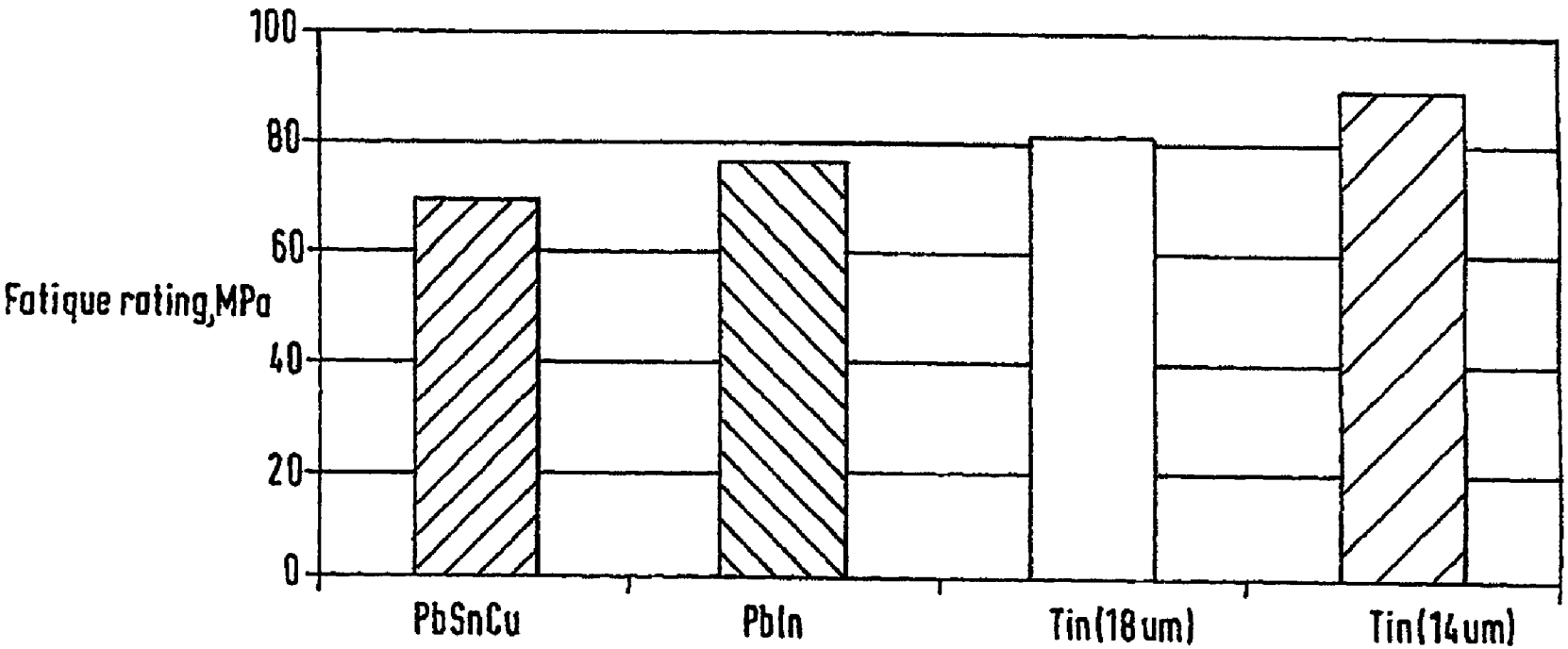
FIG. 6 shows a histogram of fatigue strength of bearings according to the present invention having a tin/organic material overlay and known Pb/In and Pb/Sn/Cu overlays.

FIG. 6 is a histogram showing the fatigue strength of bearings having the overlays specified The bearings according to the present invention were tested in two forms: one having a thickness of 18 μm at the upper end of the preferred thickness range; and, the second having a thickness of 14 μm at the lower end of the preferred thickness range. The overlay thicknesses of the prior art Pb-10Sn-2Cu and Pb-7In overlays was 15-16 μm. As may be seen from FIG. 6 the fatigue strength of the bearings according to the present invention was significantly greater than the prior art bearings.

Further tests were carried out where the tin overlay having a thickness in the range from 13 to 18 μm was deposited on bearing materials 14 of Cu-30Pb-1.5Sn and Cu-10Sn gave fatigue strengths of 90 to 103 MPa.

Figure 7:
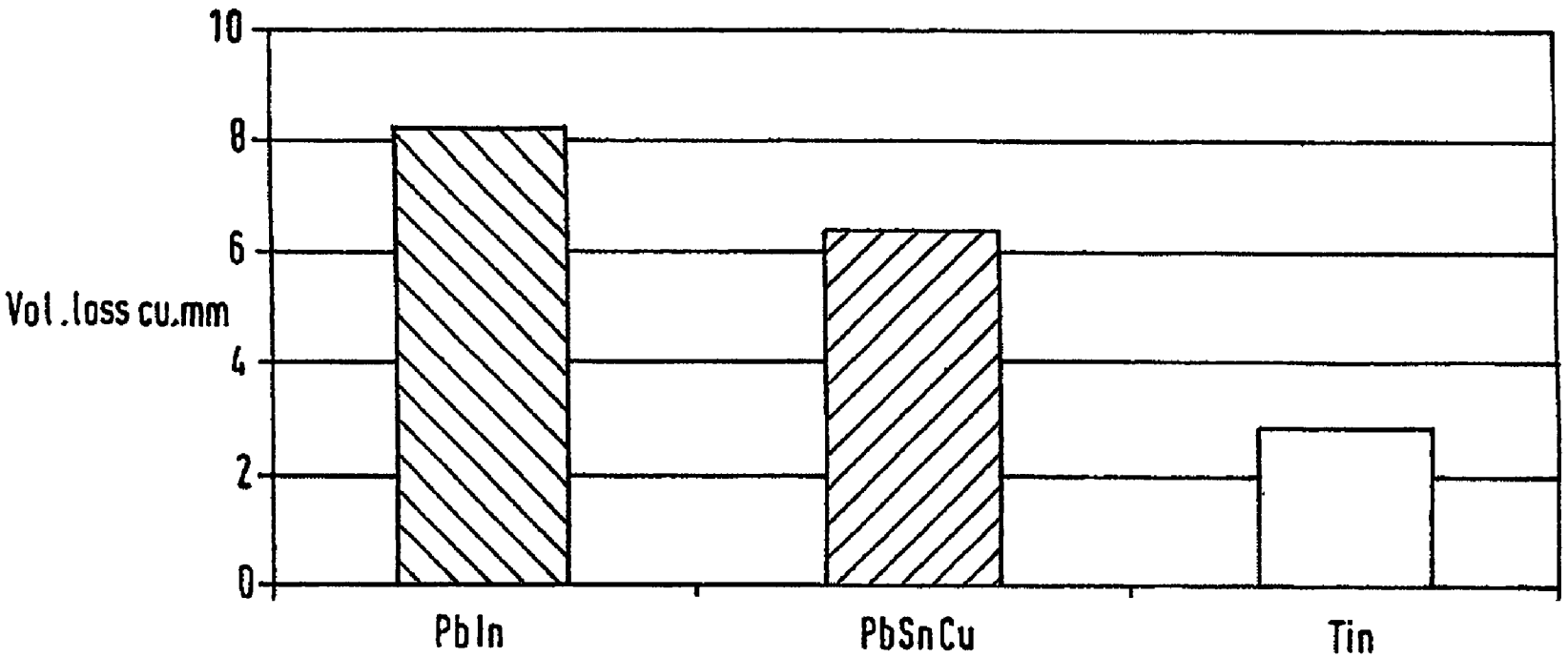
FIG. 7 shows a histogram of volume loss of overlays of bearings according to the present invention, Pb/Sn/Cu and Pb/In overlays.

FIG. 7 is a histogram showing wear test results showing volume loss of overlay on bearings according to the present invention compared with conventional overlays as described hereinabove. The test conditions were: temperature 120°; load 8 kg; speed 500 rev/min; duration 10 mins; and a constant flow of low oil at 600 ml/min. As may be seen from FIG. 7 the volume loss of overlays according to the present invention is less than 50% of Pb-10Sn-2Cu and less than 40% that of Pb-7In.

Tests were also carried out on the cavitation resistance of overlays on bearings according to the present invention. In these tests, the weight loss of the tin overlay of the inventive bearing was 9 mg whereas the weight loss of a Pb-7In overlay under identical conditions was 37 mg.

Figure 8:
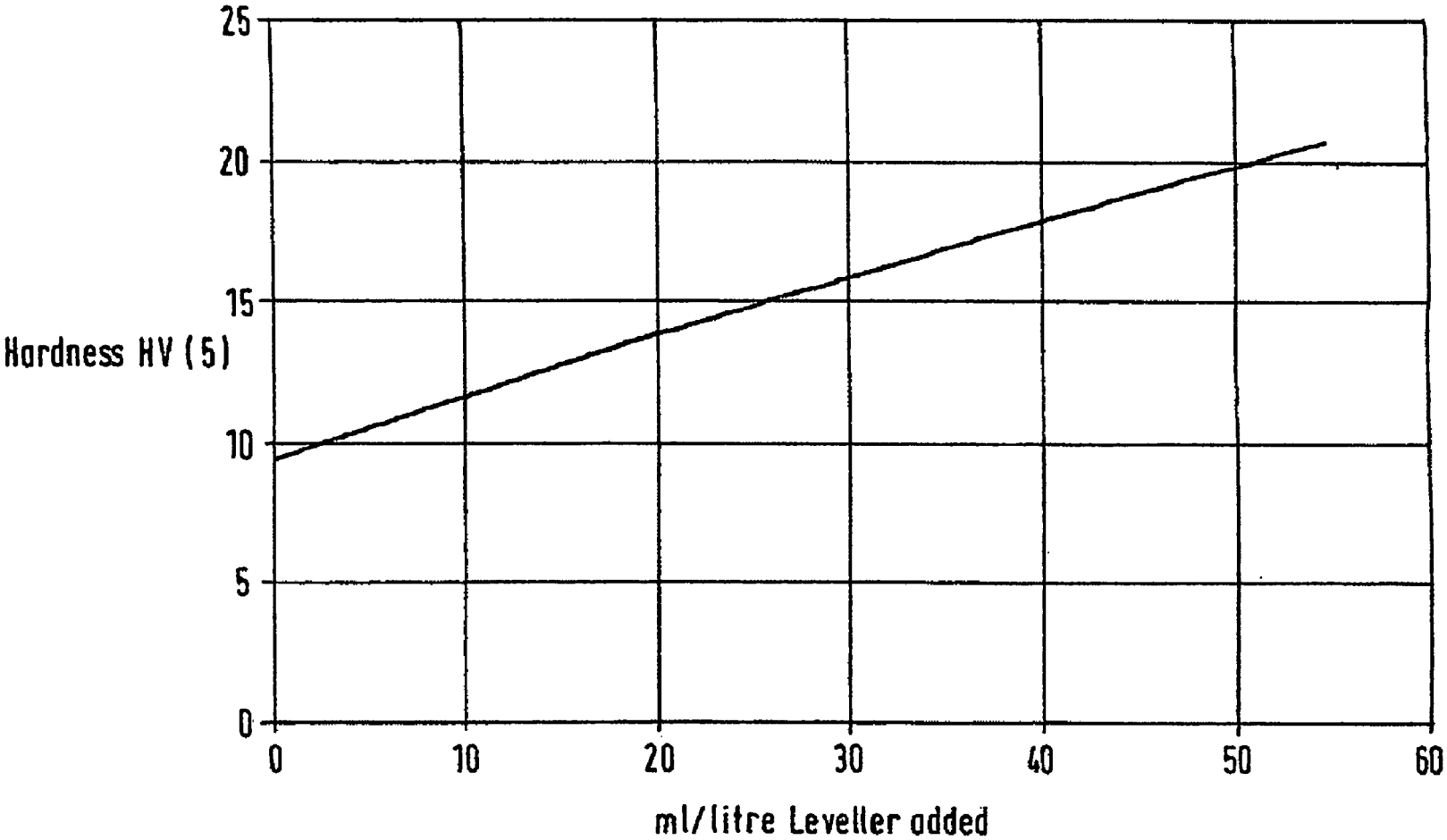
FIG. 8 shows a graph of leveler content vs hardness.

FIG. 8 shows the effect of leveler content in the plating bath on the hardness of the tin deposit. It may be seen that the hardness increases linearly with increasing content of leveler which was the same as that in the previously described example.

Figure 9:
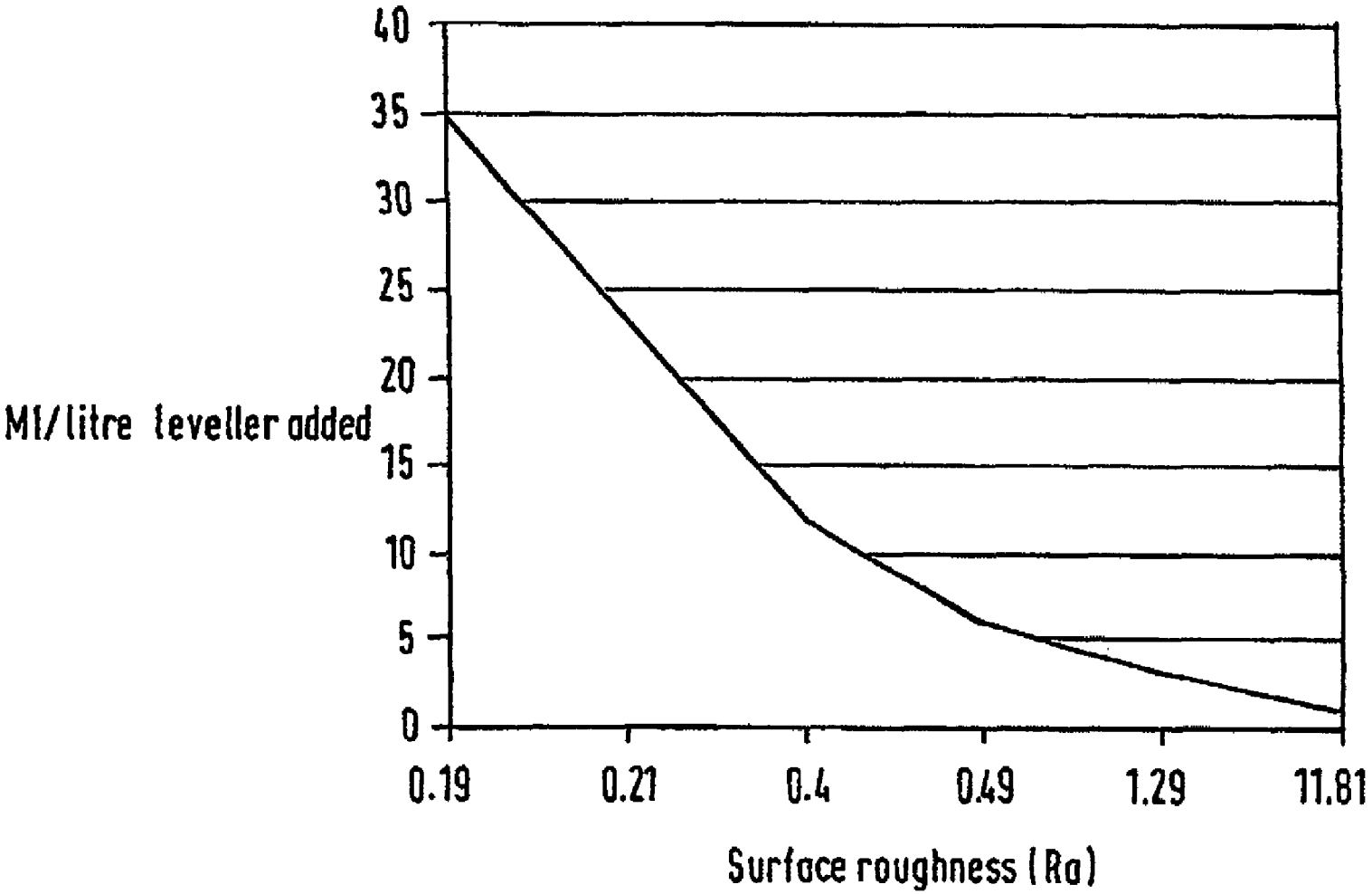
FIG. 9 which shows a graph of leveler content vs surface roughness of the deposit on a substrate.

FIG. 9 shows the effect of leveler content on surface roughness of the tin deposit. At low leveler contents below about 2 ml/l of leveler, the high roughness is a consequence of the substrate surface roughness which was an Ra of o.44 and the roughening effect of the initial, substantially leveler-free tin deposit. Once the effect of the leveler was such that the surface roughness matched that of the substrate then increasing quantities of leveler were directly proportional to the surface roughness.

Thus, relatively low contents of leveler have a strong effect in hardening and smoothing out surface roughness of the tin overlays of the present invention.

Thus, it may be seen that the performance of overlays on bearings according to the present invention is greatly superior to the best conventional overlays deposited by electro-deposition. Where the overlay is deposited upon a lead-free bearing material 14, the bearing of the present invention provides a completely lead-free bearing which complies with future legislation relating to the elimination of lead from vehicles.

The invention claimed is:

1. A plain bearing having an overlay alloy layer at a sliding surface of the plain bearing, the plain bearing comprising a layer of a strong backing material, a layer of a first bearing alloy bonded to the strong backing material and a layer of a second bearing material comprising said overlay material bonded to said first bearing alloy layer, characterised in that said second bearing material comprises essentially pure tin without any other metallic alloying constituents, other than unavoidable impurities, having included in the matrix thereof an organic levelling agent.

2. A plain bearing according to claim 1, wherein the organic levelling agent comprises at least one of nonylphenolpolyglycolether and pyrocatechol.

3. A plain bearing according to claim 1, wherein the hardness of the overlay is in the range of about 20 to 30 Hv.

4. A plain bearing having an overlay alloy layer at a sliding surface of the plain bearing, the plain bearing comprising a layer of a strong backing material, a layer of a first bearing alloy bonded to the strong backing material, an interlayer bonded to the first bearing material, and the overlay alloy layer bonded to the interlayer, wherein the overlay alloy layer comprises essentially pure tin without any other metallic alloying constituents, other than unavoidable impurities, and an organic levelling agent in the matrix thereof and the interlayer acts as a diffusion barrier layer between the first bearing alloy layer and the overlay alloy layer.

5. The plain bearing of claim 4, wherein the organic levelling agent comprises at least one of nonylphenylpolyglycolether and pyrocatechol.

6. The plain bearing of claim 4, wherein the interlayer comprises at least one of nickel, cobalt, copper, silver, iron, and alloys thereof.

7. The plain bearing of claim 4, wherein the hardness of the overlay alloy layer is in the range of about 20 to 30 Hv.

* * * * *